US008973920B2

(12) United States Patent
Hakamata

(10) Patent No.: US 8,973,920 B2
(45) Date of Patent: Mar. 10, 2015

(54) CONVEYING APPARATUS AND RECORDING APPARATUS

(75) Inventor: Keisei Hakamata, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/569,502

(22) Filed: Aug. 8, 2012

(65) Prior Publication Data

US 2013/0043648 A1 Feb. 21, 2013

(30) Foreign Application Priority Data

Aug. 19, 2011 (JP) ..... 2011-179610

(51) Int. Cl.
*B65H 5/36* (2006.01)
*B65H 5/06* (2006.01)
*B65H 9/00* (2006.01)

(52) U.S. Cl.
CPC ..... *B65H 5/062* (2013.01); *B65H 9/008* (2013.01); *B65H 5/36* (2013.01); *B65H 2404/63* (2013.01); *B65H 2404/6111* (2013.01)
USPC ..... 271/264; 271/273; 271/274; 271/225

(58) Field of Classification Search
CPC ..... B65H 5/36; B65H 5/062
USPC ..... 271/264, 226–228, 242–244, 272–274, 271/10.11, 225
See application file for complete search history.

(56) References Cited

U.S. PATENT DOCUMENTS 5,240,241 A * 8/1993 Kawazoe ..... 271/114
6,471,202 B1 * 10/2002 Sugimura ..... 271/10.11
6,733,008 B2 * 5/2004 Waragai et al. ..... 271/242
2002/0020960 A1 * 2/2002 Waragai et al. ..... 271/226
2004/0094891 A1 * 5/2004 Trovinger et al. ..... 271/227
2010/0303529 A1 * 12/2010 Shiba ..... 399/388

FOREIGN PATENT DOCUMENTS

JP 02295837 A * 12/1990
JP 03023150 A * 1/1991
JP 03088652 A * 4/1991
JP H08-157107 A 6/1996
JP 09278226 A * 10/1997
JP 2005335823 A * 12/2005
JP 2006213474 A * 8/2006
JP 2009190872 A * 8/2009
JP 2011184191 A * 9/2011
JP 2011190035 A * 9/2011

* cited by examiner

*Primary Examiner* — Luis A Gonzalez

(74) *Attorney, Agent, or Firm* — Fitzpatrick, Cella, Harper & Scinto

(57) ABSTRACT

A conveying apparatus including a conveying path with a curved path through which a sheet is passed, a main conveying roller provided downstream of the conveying path in a conveying direction of the sheet, the roller being rotated in a first direction to perform a conveying operation of conveying the sheet in the conveying direction and being rotated in a second direction opposite to the first direction to perform an skew correcting operation of forming a loop of the sheet, and an auxiliary guide member which supports the sheet using an inner side of a curvature of the conveying path and which is tilted toward the conveying direction side during the conveying operation when subjected to a force of the sheet which is stronger than during the skew correcting operation.

7 Claims, 19 Drawing Sheets

CONVEYING APPARATUS AND RECORDING APPARATUS

BACKGROUND OF THE INVENTION

1. Field of the Invention

The present invention relates to a conveying apparatus which conveys a sheet via a conveying path including a curved portion and which corrects the direction of the sheet so that a side of a leading end of the sheet is orthogonal to a conveying direction, and a recording apparatus with the conveying apparatus mounted therein.

2. Description of the Related Art

In a known configuration of recording apparatuses represented by printers, copiers, and facsimile machines, sheets are conveyed using a conveying path with a curved internal space in order to reduce the size of the apparatus. In such a recording apparatus, a sheet may be pushed hard against an outer side of the conveying path due to the rigidity of the sheet and thus conveyed while being subjected to great conveying resistance. This increases the likelihood of causing the sheet to skew. Thus, such a recording apparatus desirably performs an operation of correcting the direction of the sheet so that a side of a leading end of the sheet is orthogonal to a conveying direction, what is called an skew correcting operation, before recording an image on the sheet. A known common skew correcting operation reverses a main conveying roller (roller) engaged with the sheet. During the skew correcting operation, a loop (flexible portion) of the sheet is formed in the internal space of the conveying path. The loop comes into abutting contact with the outer side of curvature of the conveying path. Then, a force is exerted in conjunction with the abutting contact and causes a leading end of the sheet to be pushed into the main conveying roller. Japanese Patent Application Laid-Open No. H08-157107 discloses an apparatus that can adjust the above-described pressing force according to the rigidity of the sheet. The apparatus disclosed in Japanese Patent Application Laid-Open No. H08-157107 includes an upstream guide formed of a thin elastic plate and a downstream plate formed of a rigid plate and biased toward an inner side of the conveying path by a spring; the upstream and downstream guides are arranged on the outer side of a curvature of the conveying path. In this apparatus, during the skew correcting operation, less rigid sheets come into abutting contact with the upstream guide and are pushed into an skew correcting roller by the elastic force of the upstream guide. More rigid sheets come into abutting contact with the downstream guide and are pushed into a registration roller by a downstream elastic force that is greater than that of the upstream guide. During the skew correcting operation, the apparatus disclosed in Japanese Patent Application Laid-Open No. H08-157107 provides a space in the conveying path in which the sheet is deflected or flexed and can push the sheet into the registration roller with an appropriate force according to the rigidity of the sheet.

When a conveying operation and an skew correcting operation are performed within a curved conveying path in the same manner as that of the apparatus disclosed in Japanese Patent Application Laid-Open No. H08-157107, a narrow conveying path (a short distance between the inner guide and the outer guide) facilitates the abutting contact of the loop of the sheet with the conveying path and is thus suitable for the skew correcting operation. However, in this case, conveying resistance of the sheet is increased, possibly affecting the conveying operation. In contrast, a wide conveying path (a long distance between the inner guide and the outer guide) serves to reduce the conveying resistance of the sheet and is thus suitable for the conveying operation. However, this makes the abutting contact of the loop of the sheet with the conveying path difficult, possibly hindering the skew correcting operation from being stably achieved.

SUMMARY OF THE INVENTION

Thus, an object of the present invention is to provide a conveying apparatus that enables both a reduction in conveying resistance and a stable skew correcting operation, and a recording apparatus with the conveying apparatus.

To accomplish the object, a conveying apparatus according to the present invention includes a conveying path with a curved path through which a sheet is passed, a roller provided downstream of the conveying path in a conveying direction of the sheet, the roller being rotated in a first direction to enable execution of a conveying operation of conveying the sheet in the conveying direction and being rotated in a second direction opposite to the first direction to enable execution of an skew correcting operation of forming a loop of the sheet, and a guide member which guides the sheet using an inner side of a curvature of the conveying path and which can move toward the inner side of the curvature of the conveying path when subjected by the sheet during the conveying operation to a force stronger than during the skew correcting operation.

The present invention enables both a reduction in conveying resistance and a stable skew correcting operation.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

(Exemplary Embodiment 1)

Figure 1:
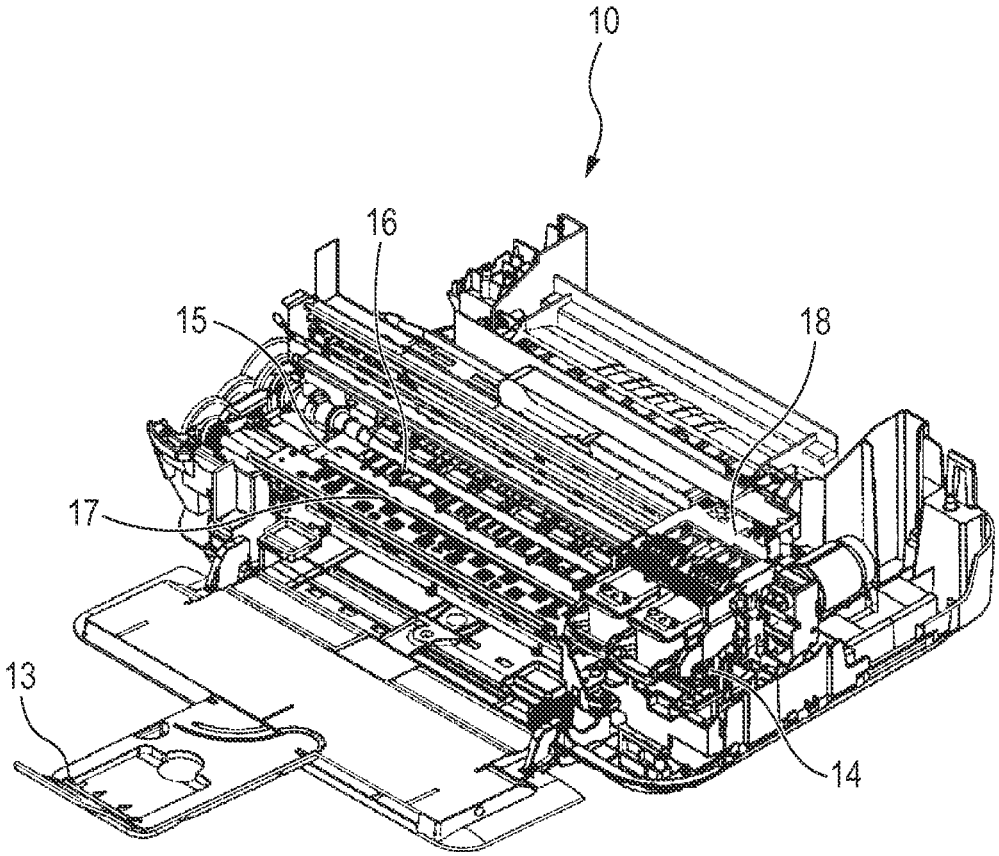
FIG. 1 is a perspective view illustrating an internal configuration of an ink jet recording apparatus that is an embodiment of a recording apparatus according to the present invention.

FIG. 1 is a perspective view illustrating an internal configuration of an ink jet recording apparatus 10 that is an exemplary embodiment of a recording apparatus according to the present invention. FIG. 1 mainly illustrates a configuration of an image forming portion 914 (see FIG. 15) that forms an image on a sheet. The image forming portion 914 includes a recording head 14, a platen 15, a pair of main conveying rollers 16, a sheet discharging roller 17, and a carriage 18. In the ink jet recording apparatus 10, a sheet conveyed to by a conveying apparatus passes through a conveying path curved in a U shape to the platen 15. Thereafter, the recording head 14 ejects ink from above the platen 15 to form an image on the sheet. At this time, the recording head 14 ejects the ink while the carriage 18 is moving in a direction orthogonal to an advancing direction of the sheet. The sheet with the image formed thereon is discharged into a sheet discharging tray 13.

Figure 2:
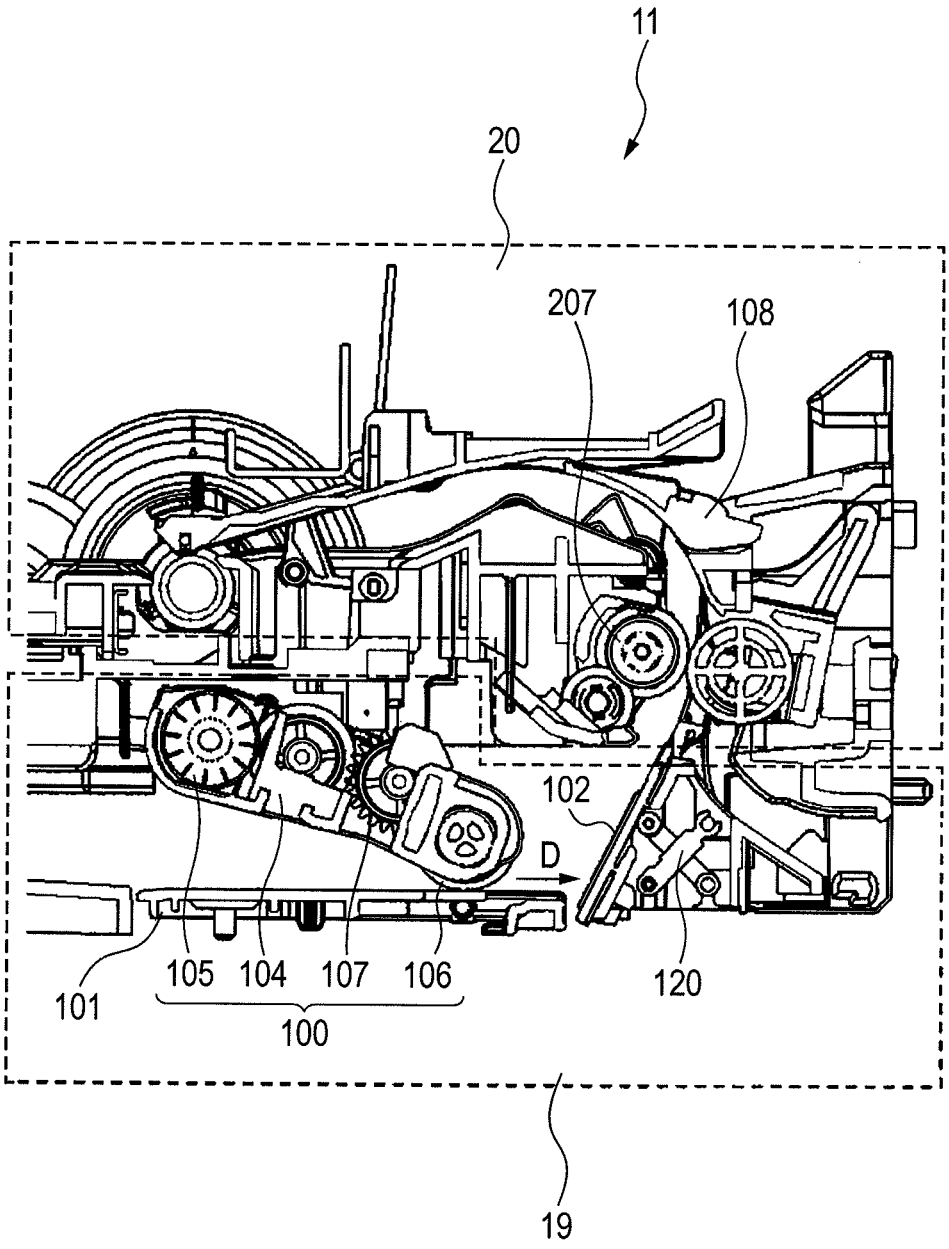
FIG. 2 is a cross-sectional view illustrating a configuration of a conveying apparatus mounted in the ink jet recording apparatus illustrated in FIG. 1.

FIG. 2 is a cross-sectional view of the conveying apparatus mounted in the recording apparatus illustrated in FIG. 1. The conveying apparatus 11 illustrated in FIG. 2 includes a sheet feeding portion 19 and a reverse conveying portion 20. First, the sheet feeding portion 19 will be described.

As illustrated in FIG. 2, the sheet feeding portion 19 includes a sheet feeding tray 101 that can accommodate a plurality of stacked sheets P. In the sheet feeding tray 101, the side surfaces of the sheets P are aligned with a side guide (not illustrated in the drawings). An inclined surface member 102 is arranged in front of the sheet feeding tray 101 in an advancing direction D of the sheet P to separate one sheet P from the plurality of sheets P. A sheet feeding mechanism 100 is arranged above the sheet feeding tray 101. The sheet feeding mechanism 100 includes a sheet feeding arm 104. When rotated around a rotating shaft 105, the sheet feeding arm 104 can be rotated according to the stack height of the sheets P stacked in the sheet feeding tray 101. The sheet feeding arm 104 includes a sheet feeding roller 106 attached to a tip thereof to advance the uppermost sheet P. The sheet feeding roller 106 is driven by power transmitted via a rotating shaft 105 and a sheet feeding idler gear 107. The sheet feeding roller 106 is in abutting contact with the uppermost sheet P. When the sheet feeding roller 106 is driven, a frictional force is exerted between the sheet feeding roller 106 and the sheet P to feed the sheet P in the advancing direction D. Thereafter, one sheet P is separated from the sheets P during passage along the inclined surface member 102 and conveyed to the reverse conveying portion 20.

The inclined surface member 102 will be described below in detail.

Figure 3:
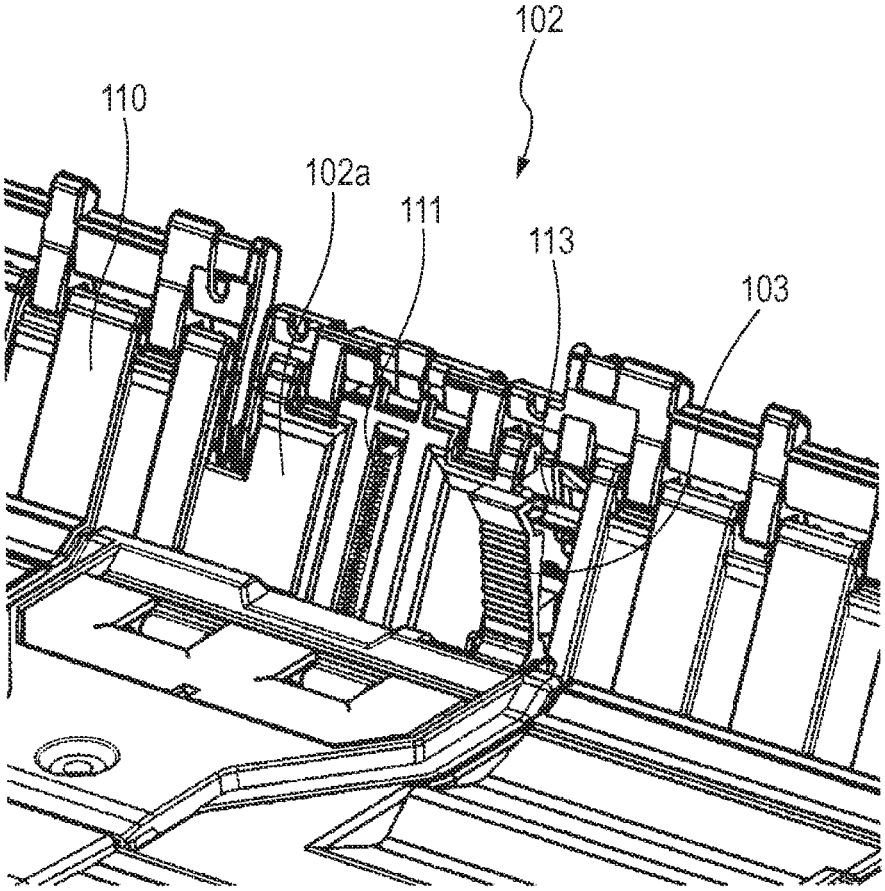
FIG. 3 is a perspective view of an inclined surface member provided in the conveying apparatus illustrated in FIG. 2.
Figure 4:
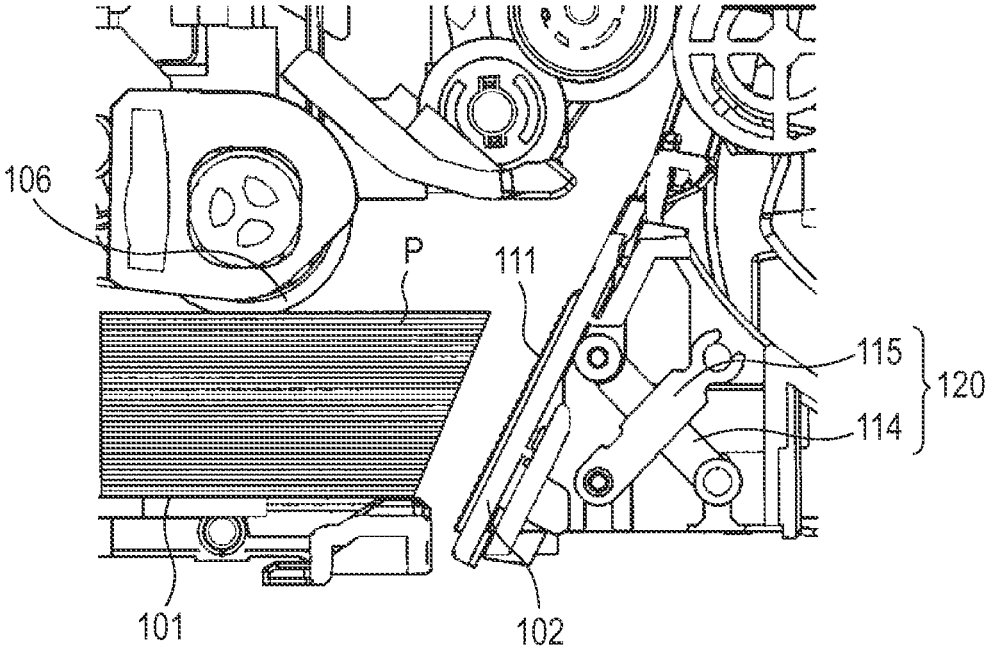
FIG. 4 is a cross-sectional view of the inclined surface member illustrated in FIG. 3.

FIG. 3 is a perspective view of the inclined surface member provided in the conveying apparatus illustrated in FIG. 2. FIG. 4 is a cross-sectional view of the inclined surface member 102 illustrated in FIG. 3. The inclined surface member 102 includes a slope 102*a* inclined at an obtuse angle to the advancing direction in order to facilitate the separation of the uppermost sheet P. The slope 102*a* includes an inclined surface guide member 110 that reduces conveying resistance when the sheet P is conveyed along the slope 102*a*. A surface of the inclined surface guide member 110 which contacts the sheet P is shaped by flattening a material with a small coefficient of friction. Two openings are formed in the slope 102*a* of the inclined surface member 102. An abutting member 103 projects from one of the openings, and a separating member 111 projects from the other opening. The abutting member 103 and the separating member 111 will be described below.

Figure 5A:
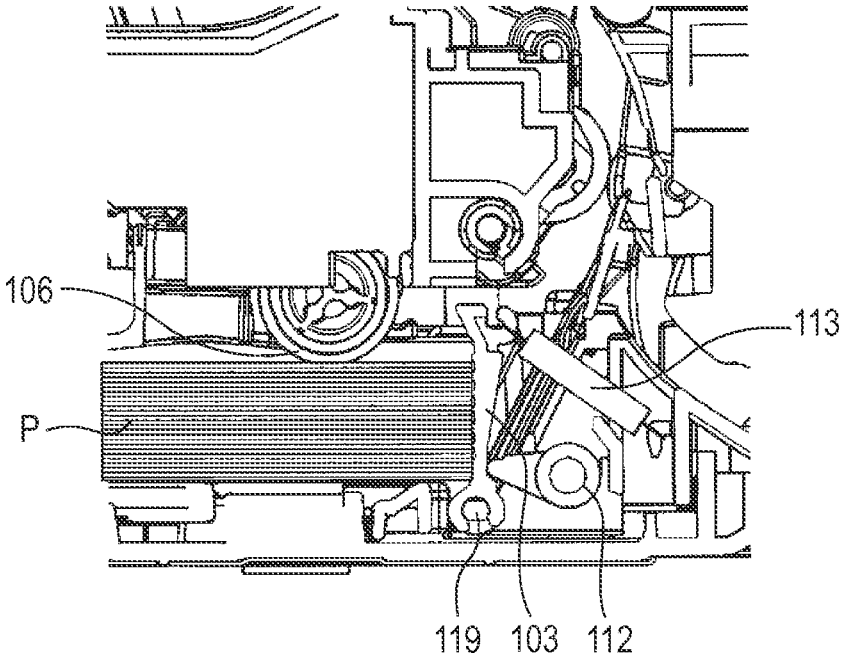
FIG. 5A and FIG. 5B are cross-sectional views of an abutting member 103 provided in the conveying apparatus illustrated in FIG. 2.
Figure 5B:
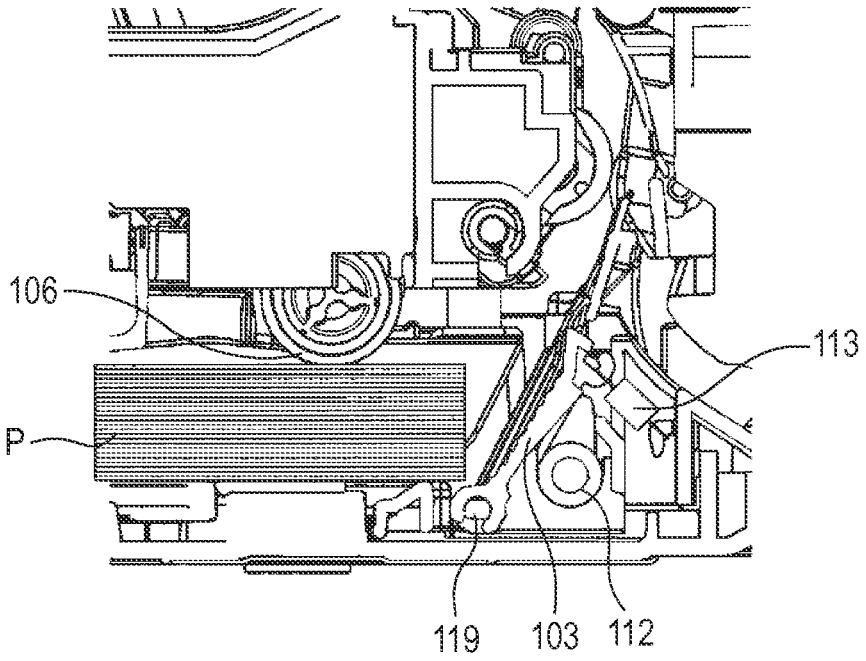

First, the abutting member 103 will be described. FIG. 5A and FIG. 5B are cross-sectional views of the abutting member 103 provided in the conveying apparatus 11 illustrated in FIG. 2. FIG. 5A illustrates that the abutting member 103 is held at a position where the abutting member 103 comes into abutting contact with leading ends of the sheets P. FIG. 5B illustrates that the abutting member 103 is held at a position where the abutting member 103 has left the leading ends and retracted with respect to the inclined surface guide member 110. The abutting member 103 is attached to a rotating shaft 119 provided at a lower side (foot side) of the slope 102*a* of the inclined surface member 102. A surface of the abutting member 103 is stepped and includes a plurality of curved surfaces. Thus, even if the abutting member 103 runs into abutting contact with the sheets P housed in the sheet feeding tray 101 in order to align the leading ends of the sheets P with the abutting member 103, damage to the sheets P can be reduced. A back surface of the abutting member 103 is pressed by a cam member 112. The cam member 112 is attached to a rotating shaft (not illustrated in the drawings) provided inside the inclined surface member 102. The abutting member 103 is pulled by a spring member 113 attached to the inclined surface member 102 and held as illustrated in FIG. 5B. When power transmitted to a rotating shaft of the cam member 112 rotates the cam member 112 counterclockwise as seen in FIG. 5B, the cam member 112 is stopped by a stopper at a position where the surface of the abutting member 103 is substantially perpendicular to the advancing direction D of the sheet P (see FIG. 5A). When the cam member 112 rotates clockwise as seen in FIG. 5A, the cam member 112 is stopped by a stopper at a position where the abutting member 103 is retracted (hidden) from the inclined surface guide member 110. The cam member 112 thus returns to the state illustrated in FIG. 5B.

Figure 6:
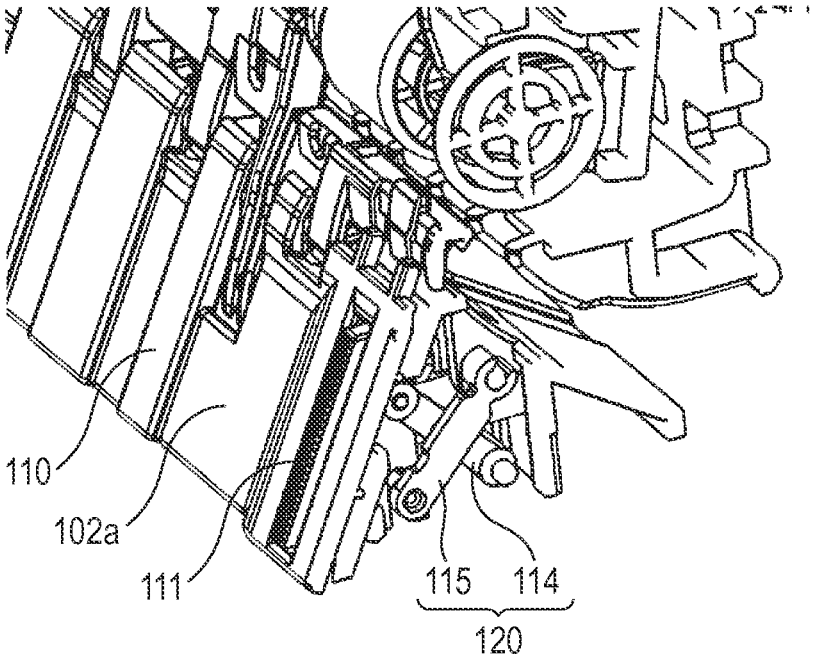
FIG. 6 is a perspective view of the surroundings of a separating member extracted from FIG. 2 illustrating the conveying apparatus.
Figure 7:
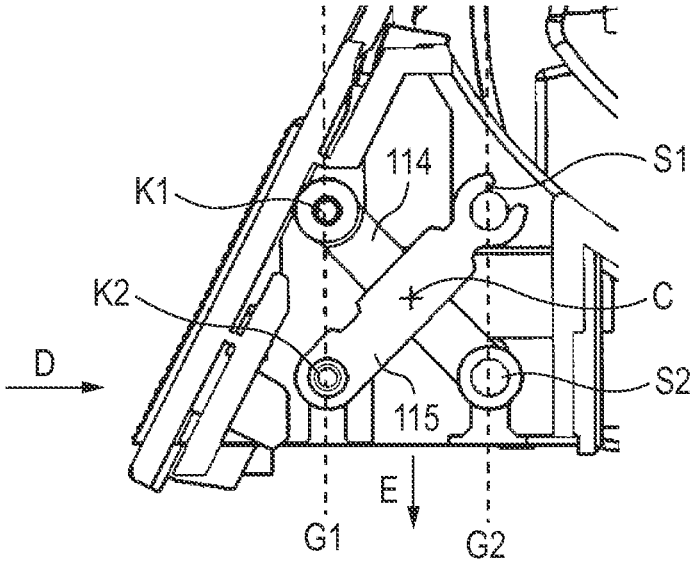
FIG. 7 is a cross-sectional view of the separating member illustrated in FIG. 6.
Figure 8A:
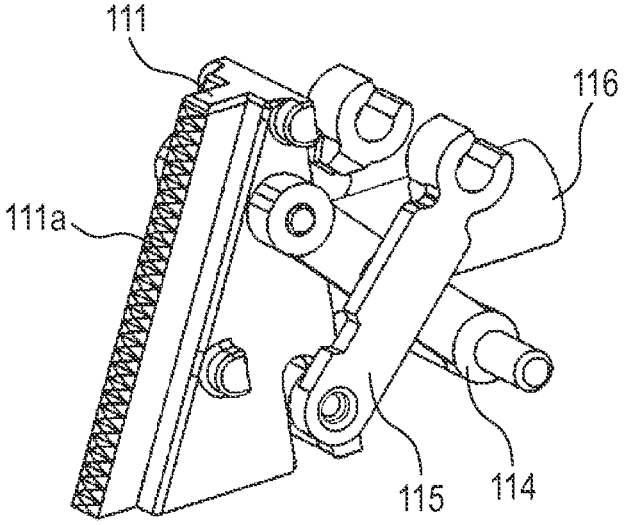
FIG. 8A and FIG. 8B are diagrams illustrating, in further detail, a configuration of the separating member illustrated in FIG. 6 and FIG. 7.
Figure 8B:
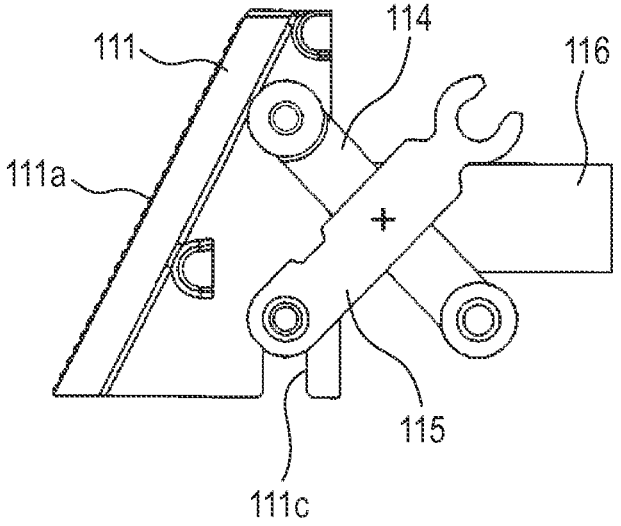

Now, the separating member 111 will be described. FIG. 6 is a perspective view of the surroundings of the separating member 111 extracted from FIG. 2 illustrating the conveying apparatus 11. FIG. 7 is a cross-sectional view of the separating member 111 illustrated in FIG. 6. FIG. 8A and FIG. 8B are diagrams illustrating, in further detail, a configuration of the separating member 111 illustrated in FIG. 6 and FIG. 7. FIG. 8A is a perspective view of the separating member 111 extracted from FIG. 6. FIG. 8B is a cross-sectional view of the separating member 111 illustrated in FIG. 8A. The separating member 111 comes into abutting contact with the sheets P, and includes a protruding surface 111*a* that is almost parallel to the slope 102*a* of the inclined surface member 102. The protruding surface 111*a* includes a plurality of protrusions arranged along an inclining direction of the protruding surface 111*a*. The separating member 111 is supported by a link mechanism 120 from a side opposite to the protruding surface 111*a*.

The link mechanism 120 moves the separating member 111 from a projecting position to a retracted position. The projecting position is where the protrusions on the protruding surface 111*a* projects with respect to the slope 102*a* of the inclined surface member 102 and where the uppermost sheet being conveyed comes into abutting contact with the protruding surface 111*a*. The retracted position is where the protrusions on the protruding surface 111*a* are retracted (hidden) with respect to the slope 102*a* of the inclined surface member 102. The link mechanism 120 will be described below.

According to the present exemplary embodiment, the link mechanism 120 includes a pair of link members 114 and 115. A central portion of the link member 114 is pivotally movably coupled to a central portion C of the link member 115. A fitting hole K1 formed at an upper end of the link member 114 is fitted over a shaft of the separating member 111. The link member 114 is rotatably attached to the separating member 111. The link member 115 includes a fitting hole formed at a lower end thereof and in which a slide shaft K2 is fitted. The separating member 111 includes a slot 111*c* formed at a position lower than a shaft fitted in the fitting hole K1. The slide shaft K2 can slide along the slot 111*c* in a direction intersecting the advancing direction D.

A straight line G1 (see FIG. 7) joining the fitting hole K1 in the link member 114 and the slide shaft K2 is set to be substantially perpendicular to the advancing direction D. Thus, according to the present exemplary embodiment, the slide shaft K2 is slidable in the direction orthogonal to the advancing direction D (see arrow E in FIG. 7).

The link member 114 includes a fitting hole formed at a lower end thereof. The fitting hole is pivotally movably fitted over a slide shaft S2 that slides in the direction of arrow E in FIG. 7. The link member 115 includes a fitting hole S1 formed at an upper end thereof and pivotally movably fitted over a shaft formed on a main body frame. A straight line G2 joining the fitting hole S1 and the slide hole S2 is set to be substantially perpendicular to the advancing direction D. Thus, like the slide shaft K2, the slide shaft S2 can slide in the direction of arrow E illustrated in FIG. 7. According to the present exemplary embodiment, the distance from each of the opposite ends of the link member 114 to the central portion C is equal to the distance from each of the opposite ends of the link member 115 to the central portion C. That is, the following are all equal: the distance from the fitting hole K1 to the central hole C, the distance from the slide shaft K2 to the central portion C, the distance from the fitting hole S1 to the central portion C, and the distance from the slide shaft S2 to the central portion C (see FIG. 7).

The separating member 111 includes a spring member 116 attached to a side thereof opposite to the protruding surface 111*a*. The spring member 116 presses the separating member 111 to hold the separating member 111 in the above-described projecting position. The pressing force of the spring member 116 acts in a direction opposite to the direction of the abutting force of the sheet P.

If the fed sheet P comes into abutting contact with the separating member 111 located at the projecting position and the abutting force received by the separating member 111 from the sheet P is greater than the pressing force of the spring member 116, the slide shaft S2 and the slide shaft K2 simultaneously slide in the direction of arrow E in FIG. 7. As a result, the link mechanism 120 is deformed to move the separating member 111 toward the above-described retracted position. The separating member 111 is hidden in the inclined surface member 102. The moving operation of the separating member 111 is similar regardless of the stack height of the sheets P stacked in the sheet feeding tray 101.

Figure 9:
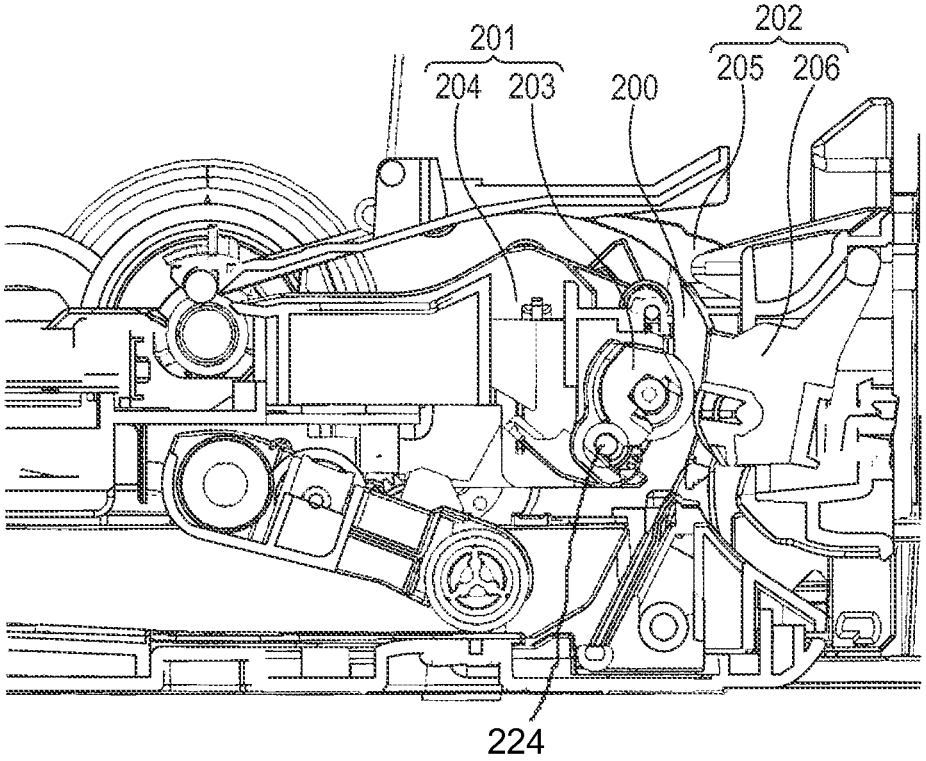
FIG. 9 is a cross-sectional view of a reverse conveying portion of the conveying apparatus.
Figure 10:
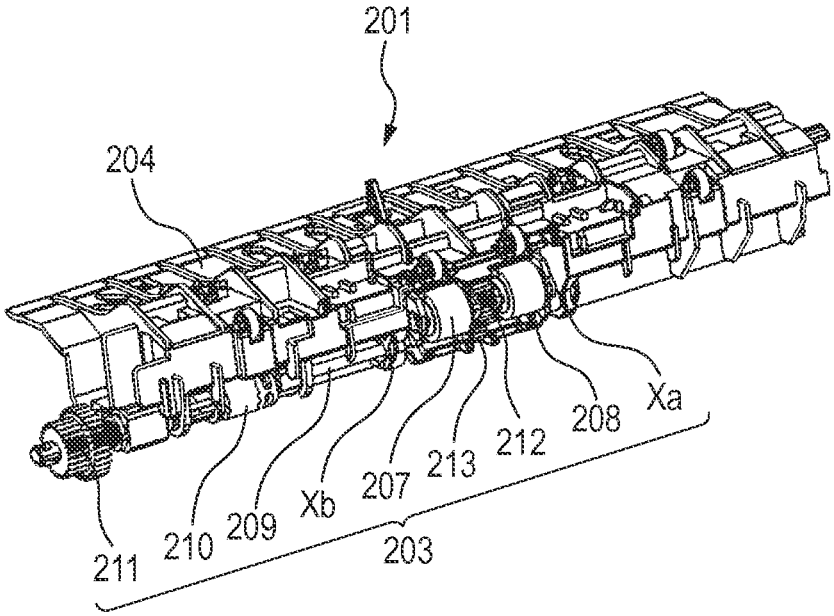
FIG. 10 is a perspective view of an inner guide unit.

Now, a configuration of the reverse conveying portion 20 will be described. FIG. 9 is a cross-sectional view of the reverse conveying portion 20 of the conveying apparatus 11. The reverse conveying portion 20 includes an inner guide unit 201 and an outer guide unit 202. First, the inner guide unit 201 will be described. FIG. 10 is a perspective view of the inner guide unit 201.

Figure 11:
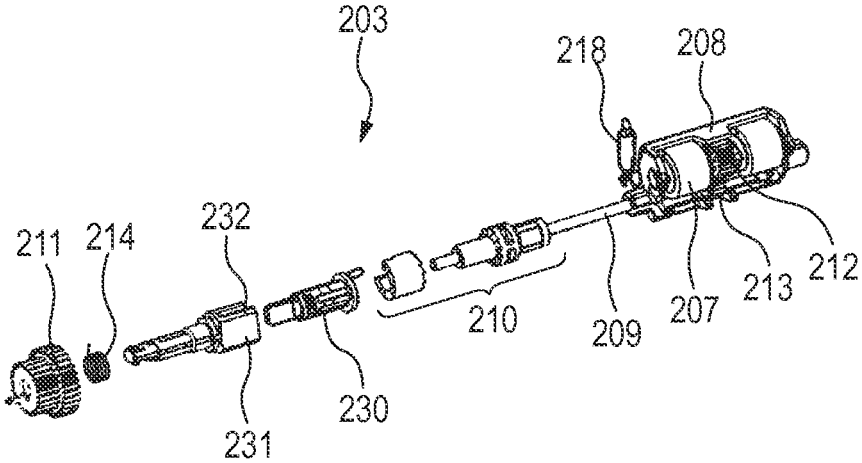
FIG. 11 is an exploded perspective view of a conveying roller unit.

The inner guide unit 201 includes an inner guide 204 of a conveying path 200 with a curved internal space through which the sheet is passed, and a conveying roller unit 203 attached to the inner guide 204. The conveying roller unit 203 will be described. FIG. 11 is an exploded perspective view of the conveying roller unit 203.

The conveying roller unit 203 includes a conveying roller 207 that is a rotor conveying the sheet in the conveying direction, a conveying arm 208 with a conveying roller 207 and a drive transmitting unit, a conveying shaft 209 that serves to transmit a drive force, and a clutch 210. An outer peripheral portion of the conveying roller 207 is formed of a high-friction member such as rubber and supported by the conveying arm 208. A roller 224 (see FIG. 9) is provided upstream of the conveying roller 207 in the conveying direction of the sheet to swing the conveying roller 207 in the conveying direction. The conveying roller 207 is of a swing arm type that revolves along an outer peripheral portion of the roller 224 to swing in the conveying direction.

The conveying arm 208 is configured to be able to swing because a shaft integrated with the conveying arm 208 is supported by holes Xa and Xb (see FIG. 10) in the inner guide 204. A supporting point of the conveying arm 208 is set upstream, in the conveying direction of the sheet, of the point of the contact between the sheet and the conveying roller 207. One end side of the conveying shaft 209 is supported by the hole Xb so as to be coaxial with a shaft of the conveying arm 208. The other end side of the conveying shaft 209 is supported by the inner guide 204 via the clutch 210. The conveying shaft 209 rotates integrally with a conveying input gear 211 connected to a drive source (not illustrated in the drawings). The conveying arm 208 is configured to be rotatable within a predetermined range by engaging with a rotation regulating portion formed on the inner guide 204. The conveying input gear 211 is fixed to the clutch 210 via a coupling member 230 and an engaging member 231. The engaging member 231 includes a recessed groove 232 formed therein and with which the coupling member 230 is engaged. A clutch spring 214 is attached between the engaging member 231 and the conveying input gear 211. One end of the clutch spring 214 is fixed to a drive frame (not illustrated in the drawings) of the inner guide unit 201 so that the engaging member 231 can be rotated only in one direction.

Rotation of the conveying input gear 211 releases the clutch spring 214 to allow the conveying shaft 209 to rotate. As a result, the conveying roller gear 212 rotates via the gear 213 fixed to the conveying shaft 209. In conjunction with the conveying roller gear 212, the conveying roller 207 rotates counterclockwise as seen in FIG. 9 to feed the sheet in the conveying direction. At this time, when the sheet being conveyed offers conveying resistance to the conveying roller 207, the turning force of the gear 213 acts as a torque that revolves the conveying roller gear 212 clockwise around the gear 213. The torque in turn acts as a pressing force that presses the conveying roller 207 against a conveying pinch roller 215. The pressing force that presses the conveying roller 207 against the conveying pinch roller 215 increases consistently with the conveying resistance of the sheet. With the conveying input gear 211 stopped, when the conveying roller 207 is rotated counterclockwise, the clutch 210 acts to block the drive transmitted from the conveying shaft 209. Thus, the clutch spring 214 is released, and the conveying roller 207 rotates at a low torque. With the conveying input gear 211 stopped, when an attempt is made to rotate the conveying roller 207 clockwise, the clutch 210 acts to transmit power to the conveying shaft 209. However, the clutch spring 214 contracts to preclude the conveying roller 207 from rotating.

Figure 12:
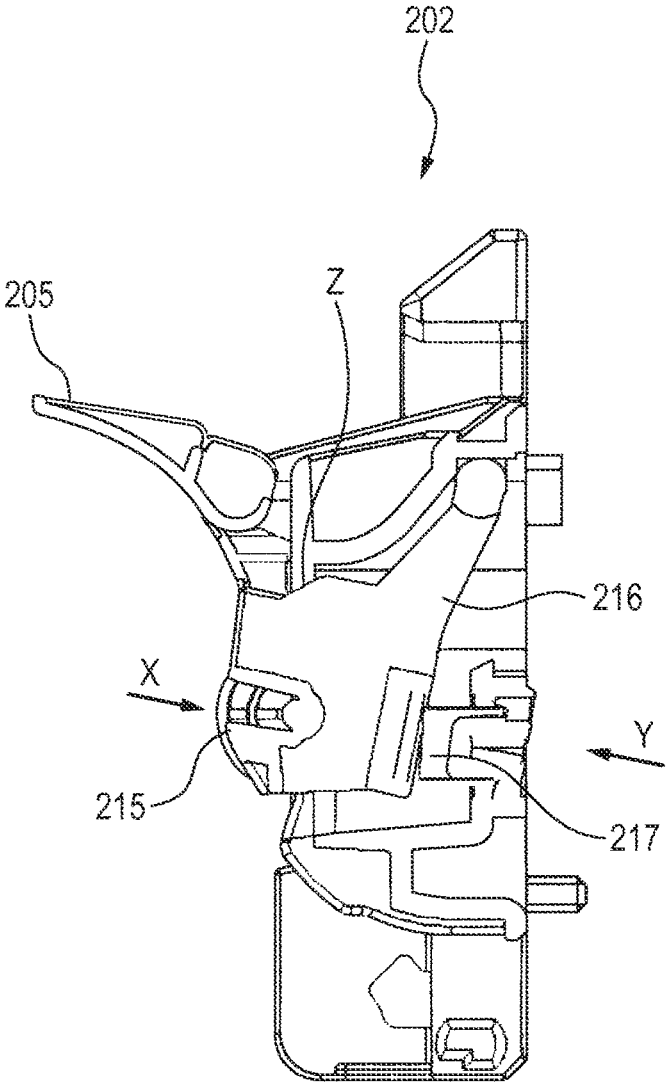
FIG. 12 is a cross-sectional view of an outer guide unit.

Now, the outer guide unit 202 will be described. FIG. 12 is a cross-sectional view of the outer guide unit 202. The outer guide unit 202 includes an outer guide 205 of the conveying path 200 and a conveying pinch roller unit 206. The conveying pinch roller unit 206 will be described.

The conveying pinch roller unit 206 includes a conveying pinch roller 215 that cooperates with the conveying roller 207 in conveying the sheet and a conveying pinch roller holder 216 to which the conveying pinch roller 215 is rotatably attached. The conveying pinch roller holder 216 is configured to be able to be swing because a shaft integrated with the pinch roller holder 216 is supported by a hole formed in the outer guide 205. The conveying pinch roller holder 216 includes a conveying pinch roller spring 217 provided on a back surface side thereof. The conveying pinch roller spring 217 presses the conveying pinch roller 215 toward the conveying roller 207 via the conveying pinch roller holder 216. The position of the conveying pinch roller holder 216 is regulated by a rotation regulating portion Z provided on the outer guide 205.

The conveying pinch roller 215 and the conveying pinch roller holder 216 remain stationary until an abutting force X (see FIG. 12) of the conveying roller 207 exceeds an elastic force Y (see FIG. 12) of the conveying pinch roller spring 217 which acts in a direction opposite to the direction of the abutting force X. When the abutting force X (see FIG. 12) exceeds the spring force X, the conveying pinch roller holder 216 and the conveying pinch roller 215 rotate counterclockwise as seen in FIG. 12 and retracts.

In the conveying roller unit 203, the conveying arm 208 includes a preload spring 218 attached thereto (see FIG. 11). The preload spring 218 keeps the conveying roller 207 stationary in abutting contact with the conveying pinch roller 215. The conveying arm 208 includes a supporting point located in a direction in which the conveying force further increases in response to the conveying resistance of the sheet. In a standby state with no conveying resistance (the sheet is not conveyed), the abutting force of the conveying roller 207 is equal to only the force of the preload spring 218. When the conveying resistance of the sheet increases during conveyance, the abutting force of the conveying roller 207 correspondingly increases. When the abutting force exceeds the elastic force Y of the conveying pinch roller spring 217, the conveying pinch roller 215 starts to retract.

Figure 13:
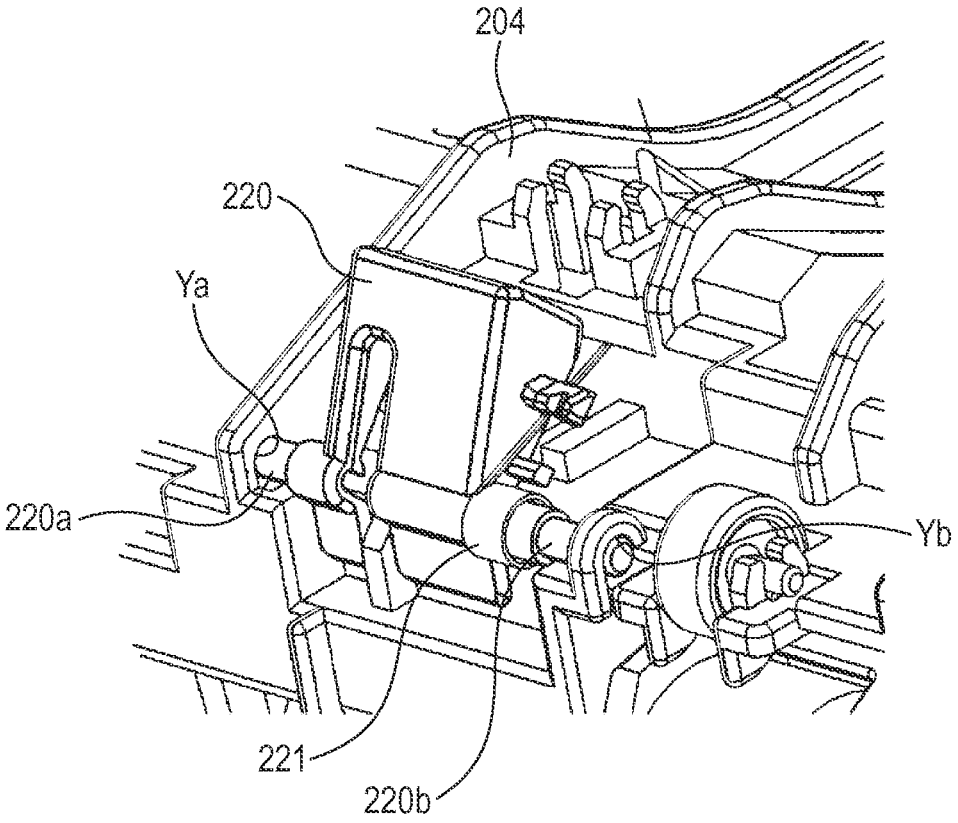
FIG. 13 is a perspective view of an auxiliary guide member.
Figure 14:
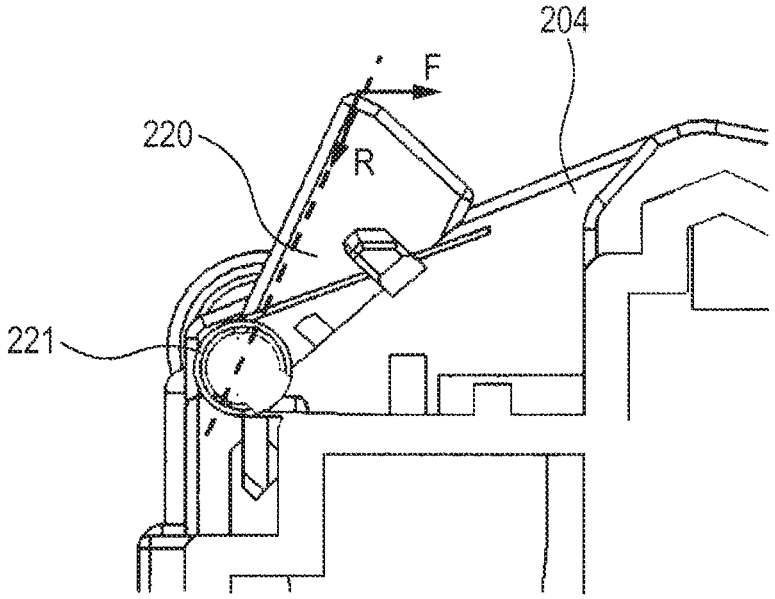
FIG. 14 is a cross-sectional view of the auxiliary guide member illustrated in FIG. 13.

In the above-described inner guide 204, an auxiliary guide member 220 is provided on an inner side a curvature of the conveying path 200. FIG. 13 is a perspective view of the auxiliary guide member 220. FIG. 14 is a cross-sectional view of the auxiliary guide member 220.

The auxiliary guide member 220 includes two shafts 220*a* and 220*b* extending in directions that intersect in the conveying direction. The shaft 220*a* is supported by a hole Ya formed in the inner guide 204. On the other hand, the shaft 220*b* is supported by a hole Yb formed in the inner guide 204. The auxiliary guide member 220 is attached to the inner guide 204 so as to be rotatable around the shafts 220*a* and 220*b*. The shaft 220*b* includes an auxiliary guide spring member 221 attached to an outer peripheral surface thereof and which is a torsion coil spring. The auxiliary guide spring 221 is engaged with the auxiliary guide member 220 at one end thereof. The auxiliary guide spring 221 is engaged with the inner guide 204 at the other end thereof. The auxiliary guide spring 221 biases the auxiliary guide member 220 toward a direction opposite to the conveying direction. The auxiliary guide member 220 includes a protrusion (not illustrated in the drawings) located at a lower end thereof so that the point of the contact between the protrusion and the inner guide 204 serves as a stopper to receive the bias force of the auxiliary guide spring 221. Thus, while no sheet is conveyed, the auxiliary guide member 220 is held in an upright posture with respect to the inner guide 204.

Figure 15:
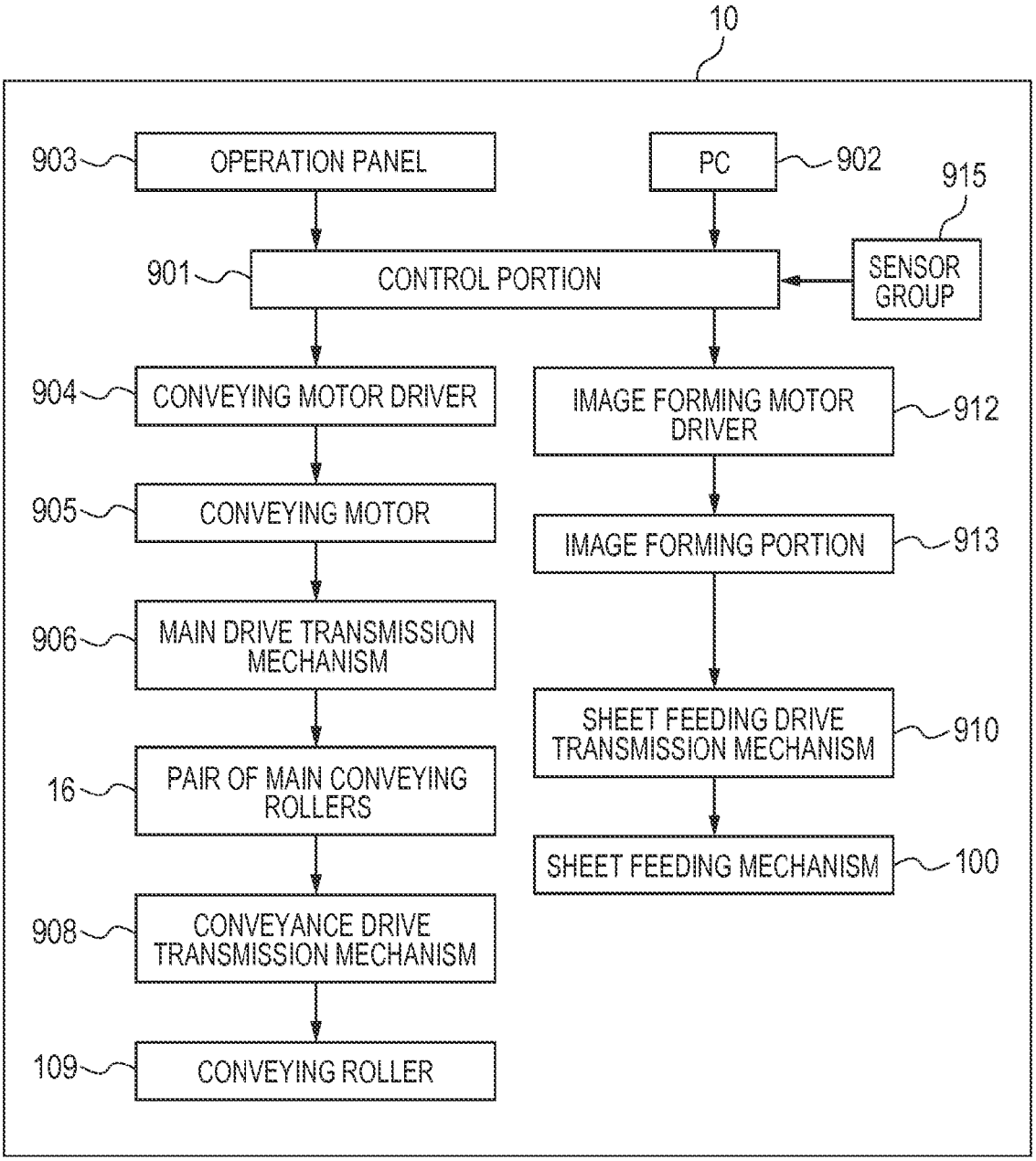
FIG. 15 is a block diagram illustrating electric control components of the ink jet recording apparatus illustrated in FIG. 1.

FIG. 15 is a block diagram illustrating electric control components of the ink jet recording apparatus 10 illustrated in FIG. 1. A control portion 901 connects to one of a PC (Personal Computer) 902 that transmits signals to the control portion 901 and an operation panel 903 installed on the apparatus main body. When the control portion 901 receives a predetermined signal from one of the PC 902 and the operation panel 903 or a timer inside the control portion 901 has measured a predetermined elapsed time, the control portion 901 starts an image forming operation. The control portion 901 instructs a conveying motor driver 904 to supply power to the conveying motor 905. A main drive transmission mechanism 906 is connected to the conveying motor 905. The conveying motor 905 drives the pair of main conveying rollers 16 via the main drive transmission mechanism 906. A conveyance drive transmission mechanism 908 is connected to the pair of main conveying rollers 16. In conjunction with the driving by the pair of main conveying rollers 16, the conveyance drive transmission mechanism 908 drives the conveying roller 207.

Furthermore, the control portion 901 instructs an image forming portion motor driver 912 to supply power to an image forming portion motor 913. An image forming portion 914 is connected to the image forming portion motor 913. A sheet feeding drive transmission mechanism 910 is connected to the image forming portion 914 and the above-described conveying drive transmission mechanism 908. The sheet feeding drive transmission mechanism 910 selectively switches between transmission and non-transmission of power from the conveyance drive transmission mechanism 908 to a sheet feeding mechanism 500 according to the position of the carriage 18 in the image forming portion 914. As a result, the sheet feeding mechanism 500 and the conveying roller 207 can be synchronously/asynchronously driven.

The rotational state and loading state of each of the above-described motors and the conveying state of the sheet P are detected by sensors of a sensor group 915 including the plurality of sensors, provided at various parts in the ink jet recording apparatus 10. Information detected by the sensor group 915 is transmitted to the control portion 901. The control portion 901 controls the motors based on signals received from one of the PC 902 and the operation panel 903 and the detection information received from the sensor group 915.

Figure 16:
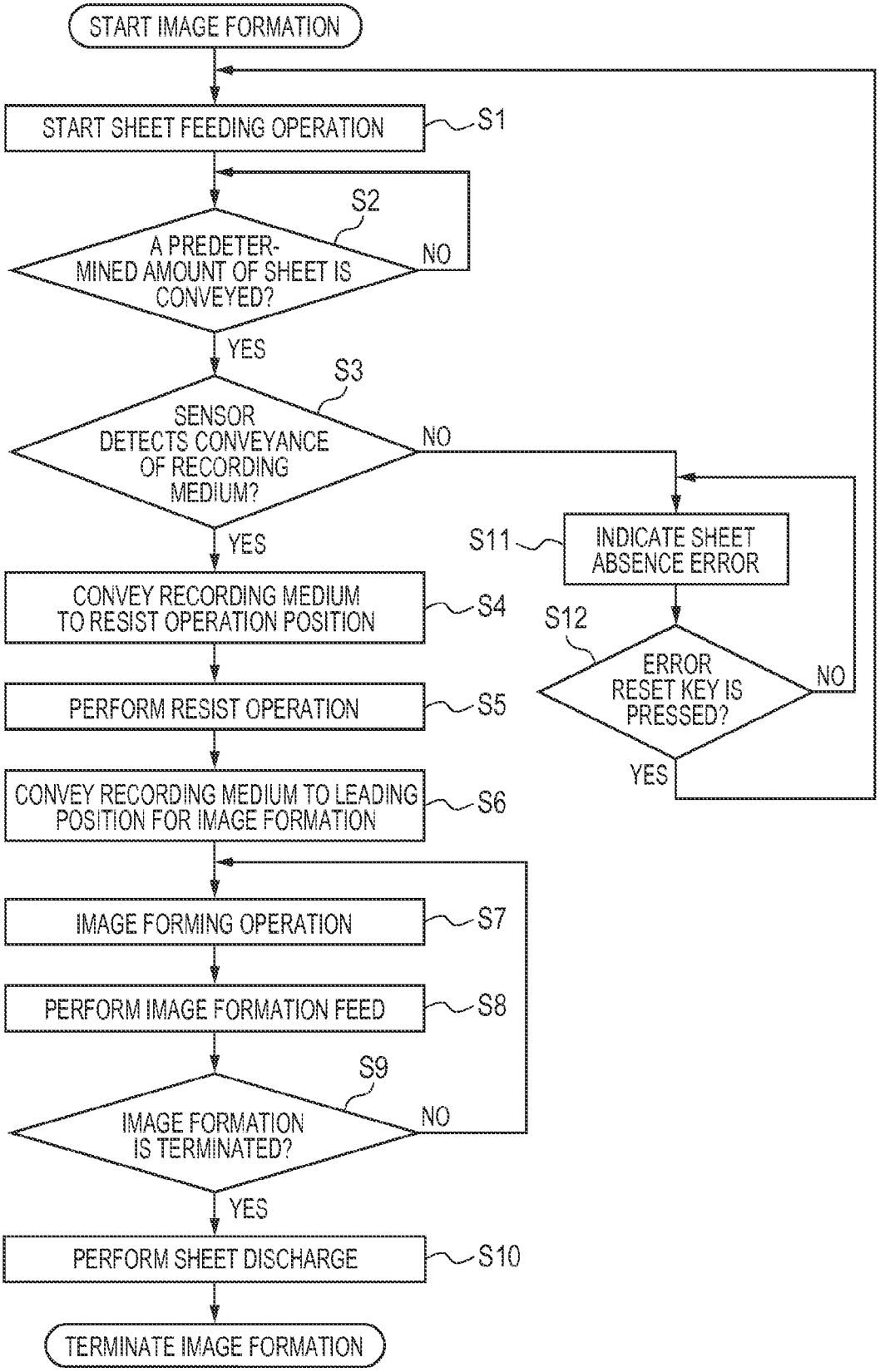
FIG. 16 is a flowchart illustrating a procedure for operations of the ink jet recording apparatus illustrated in FIG. 1.

FIG. 16 is a flowchart illustrating a procedure for operations of the ink jet recording apparatus according to the present exemplary embodiment. When the PC 902 inputs a signal indicating the start of image formation to the control portion 901, a sheet feeding operation is started (step S1). Specifically, the control portion 901 transmits the above-described instruction to the conveying motor driver 904 to drive the conveying motor 905. The sheet feeding roller 106 and the conveying roller 207 are sequentially rotated.

After a sheet feeding operation is started, the control portion 901 determines whether or not the sheet P has been conveyed by a predetermined amount (step S2). The predetermined amount is the minimum required amount of conveyance which is required for the leading end of the sheet P to reach the pair of main conveying rollers 16. Then, the control portion 901 determines whether or not a sensor 222 included in the sensor group 915 has detected the arrival of the sheet P at the pair of main conveying rollers 16 before a predetermined time elapses (step S3). If the arrival of the sheet P has not been detected, the control portion 901 allows the operation panel 903 to indicate sheet absence error (step S11), thus urging a user to re-feed a sheet P. Upon receiving the re-fed sheet through an error reset key provided on the operation panel 903 (step S12), the control portion 901 returns to the operation in step S1.

In step S3, when the sensor 222 detects when the leading end of the sheet P is about to reach the pair of main conveying rollers 16, the control portion 901 allows an skew correcting operation to be performed (step S4 and step S5). After the skew correcting operation is performed, the control portion 901 allows the pair of main conveying rollers 16 and the image forming portion 914 to perform an image forming operation (step S6 to step S8). When the image forming operation is terminated (step S9), the control portion 901 allows a discharging operation of discharging the sheet P to be performed (step S10).

The contents of the conveying operation and skew correcting operation of the main conveying roller 223, one of the pair of main conveying rollers 16, will be described below in detail.

Figure 17:
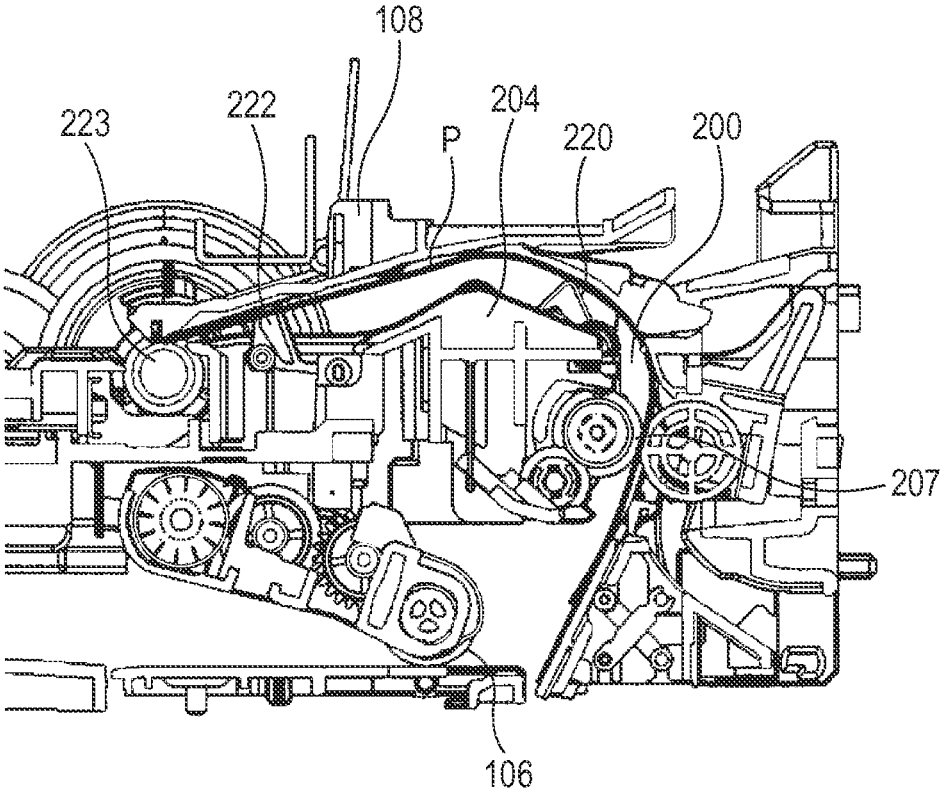
FIG. 17 is a cross-sectional view illustrating the position and state of a sheet during a conveying operation and an skew correcting operation both of which are performed by a main conveying roller.
Figure 18:
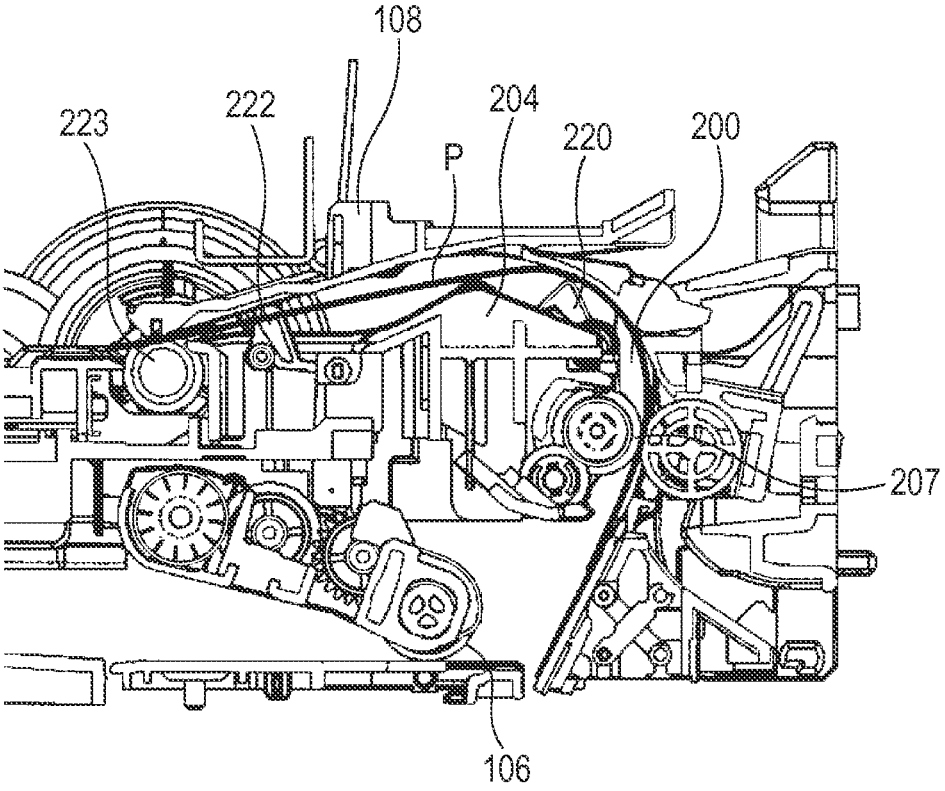
FIG. 18 is a cross-sectional view illustrating the position and state of the sheet during the conveying operation and the skew correcting operation both of which are performed by the main conveying roller.
Figure 19:
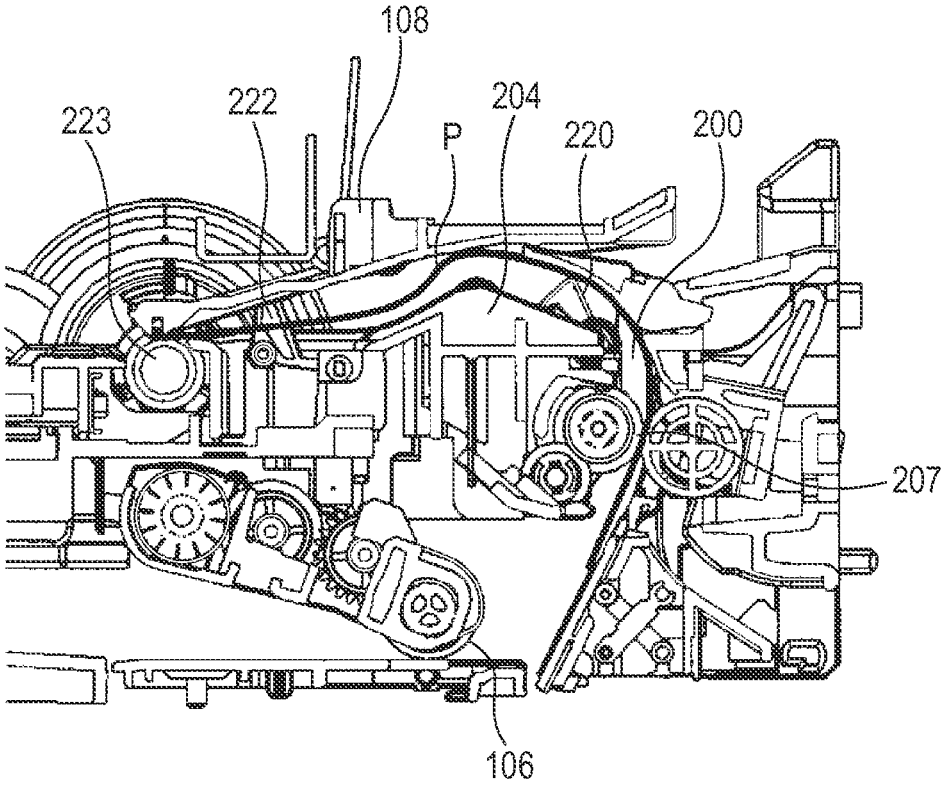
FIG. 19 is a cross-sectional view illustrating the position and state of the sheet during the conveying operation and the skew correcting operation both of which are performed by the main conveying roller.

FIG. 17 to FIG. 19 are cross-sectional views illustrating the position and state of the sheet P during the conveying operation and the skew correcting operation. According to the present exemplary embodiment, the speed ratio of each of the sheet feeding roller 106, conveying roller 207, and sheet discharging roller 17 to the main conveying roller 223 is set as follows.

The main conveying roller:the sheet feeding roller:the conveying roller:the conveying roller:the sheet discharging roller=1:0.65:0.65:1

First, the sheet feeding roller 106, the conveying roller 207, and the main conveying roller 223 rotate in a direction in which the sheet P is conveyed in the conveying direction, to start a sheet feeding operation. In this case, the direction of rotation of the main conveying roller 223 is referred to as a first direction.

The sheet feeding roller 106 and the inclined surface member 102 separate the uppermost sheet P from the sheets P stacked in the sheet feeding tray 101 with recorded surfaces thereof down. The separated uppermost sheet P is conveyed through the inclined surface member 102 to the conveying roller 207 by the sheet feeding roller 106.

Upon reaching the conveying roller 207, the sheet P is conveyed further downstream in the conveying direction by the sheet feeding roller 106 and the conveying roller 207. When conveyed by a predetermined amount after passing through the conveying roller 207, the sheet P leaves the sheet feeding roller 106 and is conveyed only by the conveying roller 207. Thereafter, when the sheet P passes through the conveying path 200, the sensor 222 detects the leading end of the sheet P. Thereafter, when the sheet P is conveyed by a predetermined amount after passing a position where the leading end of the sheet P is detected, the conveying roller 207 is stopped. The predetermined amount varies depending on the type of the sheet P such as plain paper or photographic paper. The present exemplary embodiment sets the predetermined amount such that the leading end of the sheet P is positioned 6.5 mm downstream of the conveying roller 223 in the conveying direction for plain paper and 4 mm downstream of the conveying roller 223 in the conveying direction for photographic paper.

The sheet P supported by the auxiliary guide member 220 is conveyed along the conveying guide member 108 to the main conveying roller 223 by rotation of the conveying roller 207 (see FIG. 17). According to the present exemplary embodiment, the main conveying roller 223 rotates about 1.5 times as fast as the conveying roller 207. Thus, upon starting to be conveyed by the main conveying roller 223, the sheet P in contact with the outer side of the conveying guide member 108 is drawn to the inner guide 204 side (see FIG. 18).

Then, when the main conveying roller 223 starts to rotate in a second direction opposite to the first direction, the leading end of the sheet P is returned to upstream of a nip portion between the main conveying roller 223 and a follower roller-follower, which form the pair of main conveying rollers 16. Since the conveying roller 207 is stopped, a loop of the sheet P is formed in the internal space of the conveying path 200 (see FIG. 19). As a result, one side of the leading end of the sheet P is pressed against both the main conveying roller 223 and the follower rollerfollower roller of the pair of main conveying rollers 16 on upstream of and in proximity to the nip portion between the main conveying roller 223 and the follower rollerfollower roller. Thus, the orientation of the sheet P is corrected such that the sheet P is orthogonal to the conveying direction. When the loop is in abutting contact with the conveying guide member 108, the rigidity of the sheet P serves to increase a force that presses the leading end of the sheet P to the nip portion of the pair of main conveying rollers 16. Therefore, possible skew can be efficiently corrected. If the sheet P is passing obliquely, the loop of the sheet P is twisted.

Then, when the main conveying roller 223 starts to rotate in the first direction, the loop formed in the middle of the sheet P is gradually eliminated due to a difference in velocity between the main conveying roller 223 and the conveying roller 207. Moreover, when tension is applied to the sheet P between the main conveying roller 223 and the conveying roller 207, the conveying roller 207 is rotated at a speed equal to the speed of the main conveying roller 223 via the sheet P. This eliminates the conveying resistance of the sheet P, which acts on the conveying roller 207, and the force that brings the conveying roller 207 into abutting contact with the sheet P is exerted only by the preload spring 218. Hence, only a weak force is exerted by the conveying roller 207 and the conveying pinch roller 215 in sandwiching the sheet between the rollers 207 and 215. Thus, the sheet is likely to slide with respect to the conveying roller 207 and the conveying pinch roller 215. A reaction force involved in the twist of the sheet P causes the sheet P to slide against the conveying roller 207 and the conveying pinch roller 215. This eliminates the twisted loop of the sheet P.

Figure 20A:
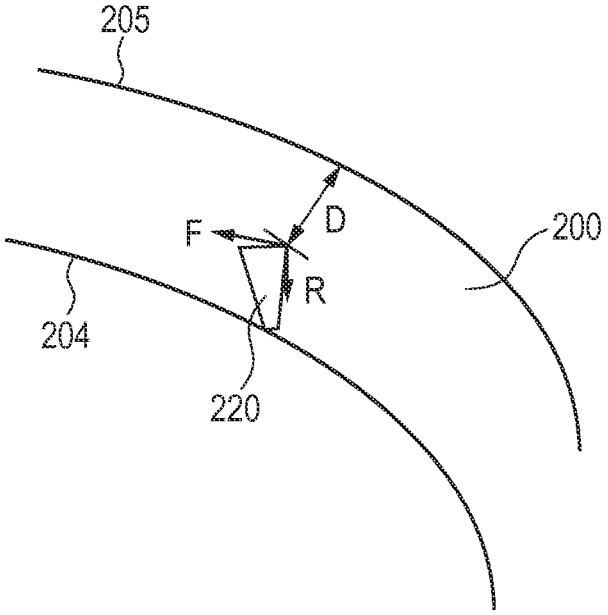
FIG. 20A and FIG. 20B are cross-sectional views illustrating operations of the auxiliary guide member.
Figure 20B:
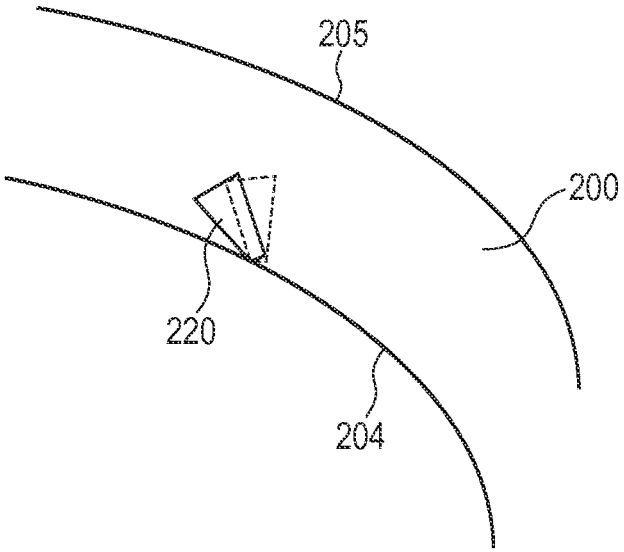

FIG. 20A and FIG. 20B are cross-sectional views illustrating operations of the auxiliary guide member 220.

Until the sheet P reaches the main conveying roller 223, the auxiliary guide member 220 is kept in an upright position by the bias force of the auxiliary guide spring member 221 so as to narrow the conveying path against a force R resulting from the weight of the sheet P and acting in the vertical direction. Also when the sheet P sandwiched between the main conveying roller 223 and the follower roller is conveyed downstream, the auxiliary guide member 220 is kept in the upright position by the bias force of the auxiliary guide spring member 221 so as to narrow the conveying path against the force resulting from the weight of the sheet P and acting in the vertical direction. While the main conveying roller 223 is performing an skew correcting operation (rotating in the second direction), the auxiliary guide member 220 receives, from the sheet P, the force resulting from the weight of the sheet P and acting in the vertical direction (see FIG. 20A). When the main conveying roller 223 performs a conveying operation (rotates in the first direction) after the skew correcting operation, the auxiliary guide member 220 receives a force acting in the conveying direction F, from the sheet P as a result of the friction between the auxiliary guide member 220 and the sheet P being moved and the tension applied to the sheet P (see FIG. 20A). The auxiliary guide member 220 is configured to rotate around the shafts 220*a* and 220*b* as described above. Thus, given a moment acting around the shafts 220*a* and 220*b*, the force in the direction R is stronger than the force in the direction F. Thus, during the conveying operation, the auxiliary guide member 220 is tilted toward the conveying direction, and the portion of the auxiliary guide member 220 which guides the sheet P moves to the inner side of the curvature (see FIG. 20B). At this time, because of the above-described rotational configuration, the auxiliary guide member 220 is subjected to only low conveying resistance even with the contact thereof with the sheet P.

To move the auxiliary guide member 220, which is movable as described above, the sheet P needs to come into contact with the auxiliary guide member 220. However, meeting the following relationship enables improvement of the reliability with which the sheet P comes into contact with the auxiliary guide member 220.

$$e \times B > D$$

The velocity ratio e indicates the velocity ratio of the conveying roller 207 to the main conveying roller 223 during the conveying operation. The conveying distance B indicates the conveying distance over which the sheet P is conveyed in the direction opposite to the conveying direction. The minimum distance D indicates the minimum distance from the outer guide 205 to the upper end of the auxiliary guide member 220.

According to the present exemplary embodiment, during the skew correcting operation, the auxiliary guide member 220 functions to narrow the conveying path 200. This enables the loop of the sheet P to reliably come into abutting contact with the outer guide 205 to stabilize the skew correcting operation. On the other hand, during the conveying operation, the auxiliary guide member 220 functions to widen the conveying path 200 to enable a reduction in conveying resistance. During the conveying operation, the sheet P is in contact with the auxiliary guide member 220, but the above-described rotational configuration reduces the conveying resistance. This enables both a reduction in conveying resistance and a stable skew correcting operation to be achieved.

(Exemplary Embodiment 2)

Figure 21:
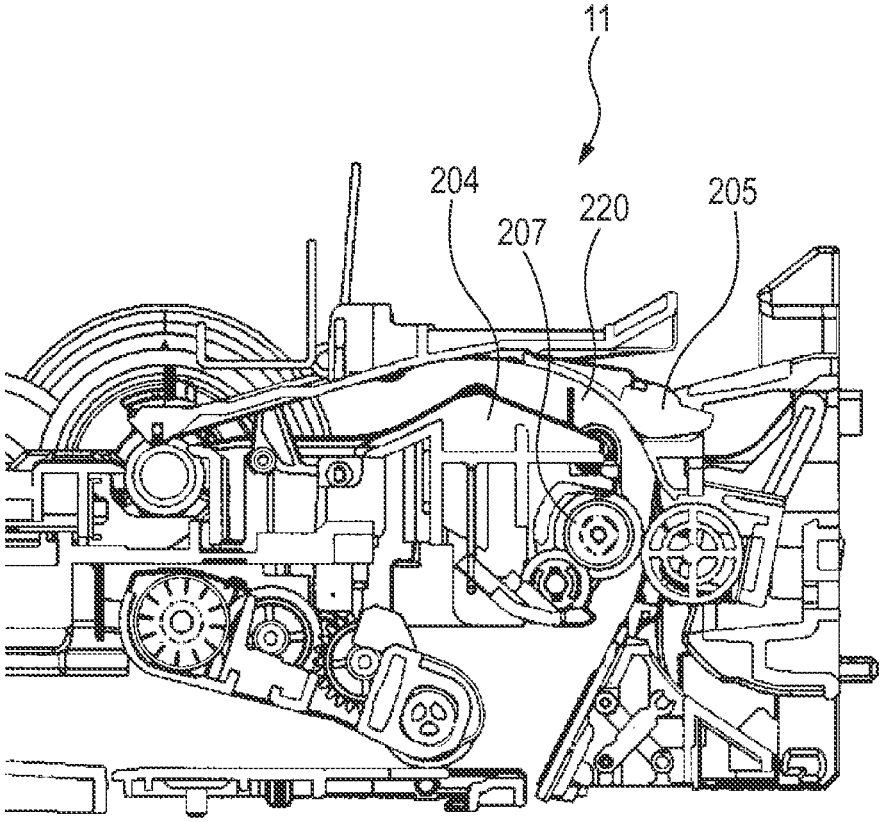
FIG. 21 is a cross-sectional view of a conveying apparatus provided in a recording apparatus according to Exemplary Embodiment 2 of the present invention.

A recording apparatus according to Exemplary Embodiment 2 will be described. The following description focuses on differences from the ink jet recording apparatus 10 according to the above-described Exemplary Embodiment 1. The present exemplary embodiment is different from Exemplary Embodiment 1 in the auxiliary guide member 220 of the conveying apparatus 11. FIG. 21 is a cross-sectional view of the conveying apparatus 11 provided in the recording apparatus according to Exemplary Embodiment 2 of the present invention. In the conveying apparatus 11 according to the present exemplary embodiment, the auxiliary guide member 220 is a flat plate-like elastic member attached to the inner guide 204. According to the present exemplary embodiment, the auxiliary guide member 220 is formed of two flat plates of polyester films of thickness 0.12 mm, width 23 mm and length 10.5 mm which are laminated together.

Figure 22:
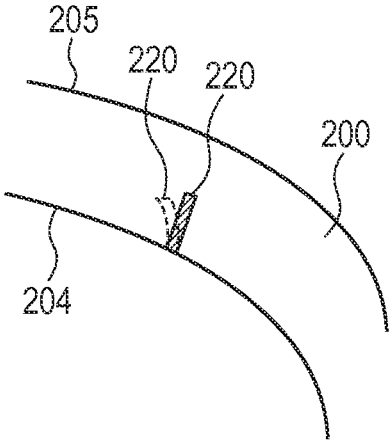
FIG. 22 is a cross-sectional view illustrating operations of the auxiliary guide member illustrated in FIG. 21.

FIG. 22 is a cross-sectional view illustrating operations of the auxiliary guide member 220.

While the main conveying roller 223 is performing a skew correcting operation, the auxiliary guide member 220 takes an upright posture with respect to the inner guide 204. After the skew correcting operation, when the main conveying roller performs a conveying operation, the auxiliary guide member 220 is deformed so as to be deflected toward the conveying direction by a force received from the sheet P as illustrated in FIG. 22. Thus, the auxiliary guide member 220 is tilted toward the conveying direction after the skew correcting section compared to during the skew correcting operation. The portion of the auxiliary guide member 220 which guides the sheet P moves to the inner side of the curvature.

According to the present exemplary embodiment, as is the case with Exemplary Embodiment 1, the auxiliary guide member 220 functions to narrow the conveying path 200 during the skew correcting operation and to widen the conveying path 200 during the conveying operation. This enables both a reduction in conveying resistance and a stable skew correcting operation to be achieved.

Moreover, compared to Exemplary Embodiment 1, the present exemplary embodiment simplifies the driving configuration for the auxiliary guide member 220, enabling a reduction in costs.

The above-described exemplary embodiments perform the skew correcting operation by reversing the main conveying roller 223 after conveying the sheet in the conveying direction using the pair of main conveying rollers 16. The present invention is applicable to any other skew correcting operation. Another skew correcting operation is as follows. The sheet P is conveyed by the conveying roller 207 so that the leading end of the sheet P comes into abutting contact with both the main conveying roller 223 and follower roller of the stopped pair of main conveying rollers 16 upstream of and in proximity to the nip portion between the main conveying roller 223 and the follower roller. The sheet P is further conveyed by the conveying roller 207 so that a loop is formed between the conveying roller 207 and the pair of main conveying rollers 16. Then, the leading end of the sheet P is pressed against both the main conveying roller 223 and the follower roller. One side of the leading end is aligned with a longitudinal direction of the main conveying roller 223. Such a method may be used to correct possible skew. Furthermore, at this time, the skew correcting operation can be similarly performed even when the main conveying roller 223 is rotated in the direction opposite to the conveying direction.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-179610, filed Aug. 19, 2011, which is hereby incorporated by reference herein in its entirety.

What is claimed is:

1. A recording apparatus comprising:

a recording head configured to record an image on a sheet;

a first conveying roller located upstream of the recording head in a sheet conveying direction and configured to convey the sheet;

a second conveying roller located upstream of the first conveying roller in the sheet conveying direction and configured to convey the sheet, the second conveying roller swinging in the sheet conveying direction;

a conveying path curved in a U shape, the conveying path being provided between the first conveying roller and the second conveying roller and having an inner guide and an outer guide;

a guide member provided in the inner guide, the guide member being movable to a first position projecting from the inner guide until a leading end of a sheet reaches the first conveying roller and movable to a second position having a projecting amount from the inner guide, which is smaller than that of the first position when the sheet is conveyed to a position opposed to the recording head.

2. The recording apparatus according to claim 1, wherein the guide member comprises a shaft extending in a direction intersecting the sheet conveying direction and rotates around the shaft in the sheet conveying direction by the force during the conveying operation.

3. The recording apparatus according to claim 1, wherein the guide member is a flat plate-like elastic member that is deflected in the sheet conveying direction by the force during the conveying operation.

4. The recording apparatus according to claim 1, wherein the second conveying roller rotates during the conveying operation to cooperate with the first conveying roller in conveying the sheet, while being stopped during a skew correcting operation.

5. The recording apparatus according to claim 4, wherein the first conveying roller rotates at a higher speed than the second conveying roller during the conveying operation.

6. The recording apparatus according to claim 5, wherein a relationship $e \times B > D$ holds true between a velocity ratio of the first conveying roller and the second conveying roller e during the conveying operation and a conveying distance B over which the sheet is conveyed during the skew correcting operation and a minimum distance D from an outer side of the conveying path to an upper end of the guide member.

7. The recording apparatus according to claim 1, further comprising a third roller positioned upstream of the second conveying roller in the sheet conveying direction to swing the second conveying roller in the sheet conveying direction.

* * * * *